United States Patent [19]

Kohama et al.

[11] 4,148,286

[45] Apr. 10, 1979

[54] EXHAUST GAS RECIRCULATION SYSTEM FOR AN INTERNAL COMBUSTION ENGINE

[75] Inventors: Tokio Kohama, Nishio; Hideki Obayashi, Hoi; Tadashi Ozaki, Nishio; Hidetaka Nohira, Susono, all of Japan

[73] Assignees: Nippon Soken, Inc., Nishio; Toyota Jidosha Kogyo Kabushiki Kaisha, Toyota, both of Japan

[21] Appl. No.: 837,865

[22] Filed: Sep. 29, 1977

[30] Foreign Application Priority Data

Oct. 1, 1976 [JP] Japan ..... 51-118736
Oct. 1, 1976 [JP] Japan ..... 51-118737

[51] Int. Cl.[2] ..... F02M 25/06
[52] U.S. Cl. ..... 123/119 A
[58] Field of Search ..... 123/119 A

[56] References Cited

U.S. PATENT DOCUMENTS

| | | | |
|---|---|---|---|
| 3,814,070 | 6/1974 | Wertheimer | 123/119 A |
| 3,926,161 | 12/1975 | Wertheimer | 123/119 A |
| 4,075,992 | 2/1978 | Linder et al. | 123/119 A |

*Primary Examiner*—Wendell E. Burns
*Attorney, Agent, or Firm*—Cushman, Darby & Cushman

[57] ABSTRACT

An engine exhaust gas recirculation system has an E.G.R. passage for recirculating exhaust gases from an exhaust system of an engine back into an intake system thereof downstream of a throttle valve. The E.G.R. passage has a restriction orifice therein and an E.G.R. control valve responsive to a vacuum signal to control the recirculation of exhaust gases through the E.G.R. passage. A pressure comparator and modulator is pneumatically connected to the E.G.R. passage upstream and downstream of the restriction orifice, to the carburetor venturi, to the intake manifold and to the E.G.R. control valve and operative to compare the venturi vacuum with the exhaust gas pressure difference across the restriction orifice thereby to modulate the intake manifold vacuum to be fed to the E.G.R. control valve so that the latter is controlled by the thus modulated vacuum to keep the exhaust gas pressure difference proportional to the venturi vacuum whereby the volumetric quantity of recirculated exhaust gases is made proportional to the volumetric quantity of engine intake air.

7 Claims, 5 Drawing Figures

EXHAUST GAS RECIRCULATION SYSTEM FOR AN INTERNAL COMBUSTION ENGINE

BACKGROUND OF THE INVENTION

1. Field of the Invention

The present invention relates to an engine exhaust gas recirculation system effective to reduce the emission of nitrogen oxides ($NO_x$).

2. Description of the Prior Art

The prior art engine exhaust gas recirculation systems (hereunder called "E.G.R. systems") conventionally used to reduce $NO_x$ emission are classified into plate type and manifold type. The E.G.R system of the plate type includes an E.G.R. passage extending from an exhaust pipe of an engine to an intake pipe thereof between a carburetor venturi and a throttle valve. A fixed restriction orifice is provided in the E.G.R. passage. The recirculation of engine exhaust gases according to this type of E.G.R. system is a function of the engine back pressure. In the manifold type E.G.R. system, an E.G.R. passage having a restriction provided therein extends from the exhaust pipe to the intake manifold downstream of a throttle valve.

E.G.R. systems of both types are generally called "external E.G.R.". In contrast, it has been found that residual gases retained in combustion chambers of an engine are also effective to reduce the $NO_x$ emission. Thus, to retain a part of combustion gases in the combustion chambers is called "internal E.G.R.". Thus, the total amount of exhaust gases obtained by the external and internal E.G.R.s must be taken into consideration.

In order to most efficiently reduce the $NO_x$ emission, it is desirable to keep constant the ratio of the total amount of exhaust gases obtained by the external and internal E.G.R.s to the amount of engine intake air (i.e., total E.G.R. rate). It has been found that the rate of the internal E.G.R. is increased and decreased as the load on the engine is decreased and increased, respectively. Accordingly, in order to keep constant the total E.G.R. rate, the external E.G.R. system must be controlled such that the external E.G.R. rate is increased and decreased as the engine load is increased and decreased, respectively.

The plate type E.G.R. system of the prior art has an advantage that the amount of the recirculated exhaust gases is proportional to the amount of the engine intake air so that the total E.G.R. rate obtained is substantially close to the desirable total E.G.R. rate. The E.G.R. system of this type, however, has disadvantageous problems that a deposit of a foreign material is formed on the throttle valve, the carburetor suffers from themral influence, icing occurs at a low temperature, and so on.

In the manifold type E.G.R. systems, the disadvantageous problems of the plate type E.G.R. system hardly occur because exhaust gases are recirculated directly into the intake manifold downstream of the throttle valve. In the manifold type E.G.R. systems, however, the recirculation of exhaust gases is controlled by pressure signals obtained from the venturi vacuum or intake manifold vacuum. Thus, the amount of recirculated exhaust gases is dependent on the pressure difference between the engine back pressure and the intake vacuum and on the exhaust gas-flow cross-sectional area of the restriction orifice in the E.G.R. passage. The amount of recirculated exhaust gases is influenced particularly by the intake vacuum, so that the external E.G.R. rate is increased and decreased as the engine load is decreased and increased, respectively. This external E.G.R. control characteristic is opposite to the desirable external E.G.R. control with resultant occurence of surging and misfires at a light load engine operating condition and thus with decrease in the reduction of $NO_x$ emission.

SUMMARY OF THE INVENTION

The present invention has its object to provide an improved E.G.R. system operative to control the external E.G.R. so that the external E.G.R. rate is increased and decreased as the engine load is increased and decreased, respectively, whereby the total E.G.R. rate is kept constant to most efficiently reduce the $NO_x$ emission.

The engine exhaust gas recirculation system according to the present invention comprises an E.G.R. passage for recirculating engine exhaust gases from an exhaust system of an engine back into an intake system thereof downstream of a throttle valve. An E.G.R. control valve means is associated with the E.G.R. passage and operative in response to a pressure signal to vary the exhaust gas-flow cross-sectional area of the E.G.R. passage. A restriction means is disposed in the E.G.R. passage upstream or downstream of the E.G.R. control valve means. A pressure comparator and modulator is operative to compare the venturi vacuum with the pressure difference between the exhaust gas pressures in the E.G.R. passage upstream and downstream of the restriction means and modulate the pressure signal so that the exhaust gas pressure difference is always proportional to the venturi vacuum whereby the volumetric quantity of engine intake air.

The pressure comparator and modulator may preferably be pneumatically connected to the intake manifold of the engine and to the E.G.R. control valve means so that the intake manifold vacuum is modulated by the pressure comparator and modulator and the thus modulated vacuum is fed to the E.G.R. control valve means for the control of the exhaust gas pressure difference across the restriction means.

The above and other objects, features and advantages of the present invention will be made more apparent by the following description with reference to the accompanying drawings.

DESCRIPTION OF PREFERRED EMBODIMENTS

Figure 1:
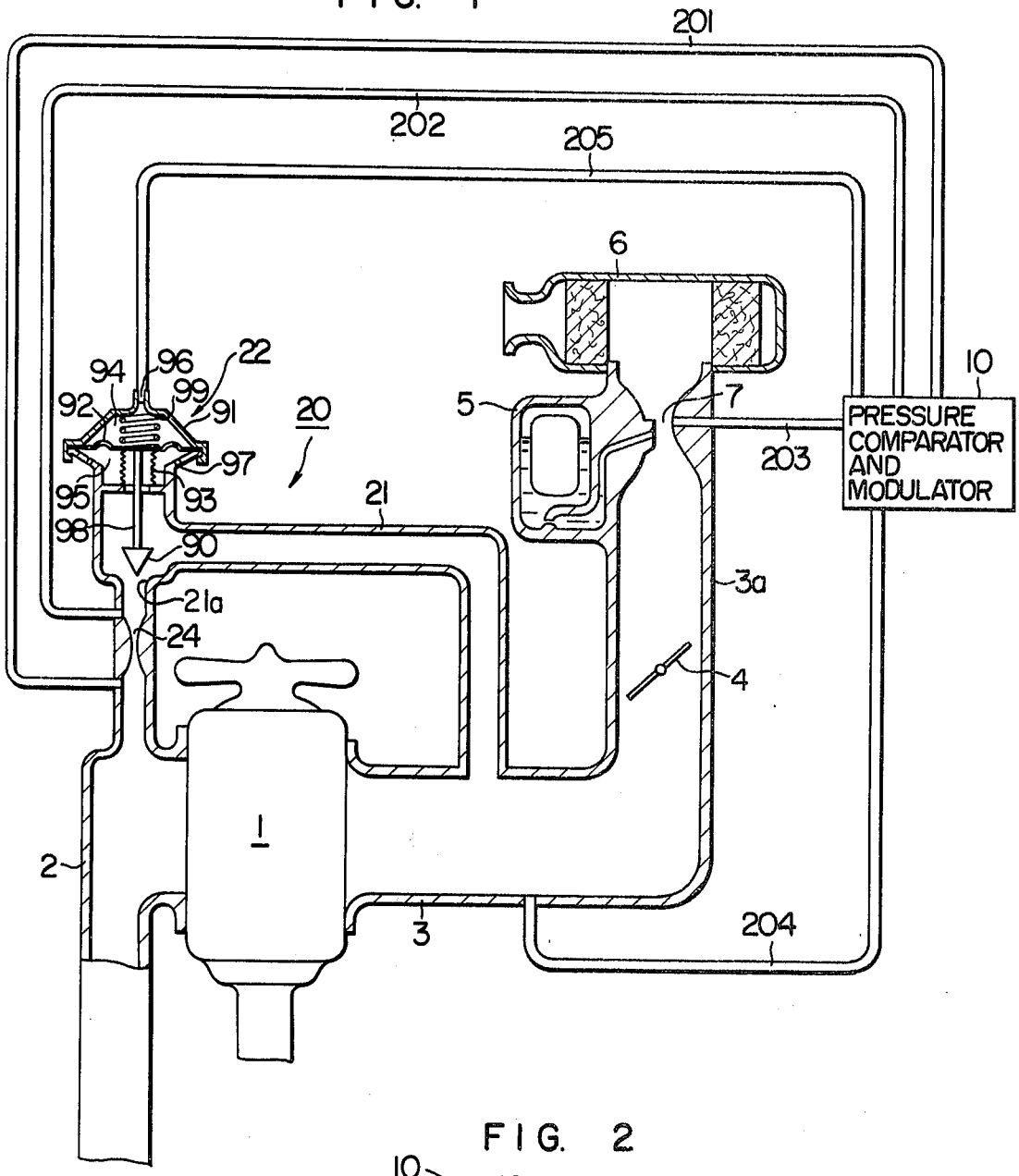
FIG. 1 diagrammatically illustrates a first embodiment of the engine exhaust gas recirculation system according to the present invention.

Referring first to FIG. 1 which illustrates a first embodiment of the invention, an internal combustion engine 1 has an exhaust manifold 2 and an intake manifold 3 having an upstream end connected with an intake pipe 3*a* in which a throttle valve 4 is pivotally provided. A carburetor 5 is provided upstream of the intake pipe 3*a* to produce a mixture of air from an air cleaner 6 and gasoline supplied from a fuel supply source (not shown). The carburetor 5 defines a venturi 7 of a conventional structure.

An exhaust gas recirculating system (hereinafter called "E.G.R. system") 20 includes an E.G.R. passage 21 defined by an E.G.R. pipe extending between the exhaust manifold 2 and the intake manifold 3 downstream of the throttle valve 4. An E.G.R. control valve 22 is provided between the ends of the E.G.R. pipe 21 to control the rate of recirculation of the engine exhaust gases from the exhaust manifold 2 back into the intake manifold 3, as will be discussed in more detail later. A fixed restriction orifice 24 is provided in the E.G.R. pipe 21 between the E.G.R. control valve 22 and the exhaust manifold 2.

The E.G.R. control valve 22 is actuated and controlled by a pressure signal which a pressure comparator and modulator 10, to be fully described later, produces in accordance with a signal representative of the amount of engine intake air and a signal representative of the amount of recirculated exhaust gases. In the illustrated embodiment of the invention, the signal representative of the amount of the recirculated exhaust gases is provided by the difference in the exhaust gas pressure across the restriction orifice 24 (this pressure difference will be called hereunder "E.G.R. pressure difference across restriction orifice"). For this purpose, the pressure comparator and modulator 10 is pneumatically communicated through first and second pressure conduits 201 and 202 with the E.G.R. passage 21 upstream and downstream of the restriction orifice 24, respectively. The signal representative of the amount of the engine intake air is provided by the venturi vacuum produced at the venturi 7 of the carburetor 5. Thus, the pressure comparator and modulator 10 is pneumatically communicated with the venturi 7 by a third pressure conduit 203. The pressure comparator and modulator 10 is also pneumatically connected to the intake manifold 3 downstream of the throttle valve 4 by a fourth pressure conduit 204 and is also pneumatically communicated with the E.G.R. control valve 22 by a fifth pressure conduit 205. The pressure comparator and modulator 10 is operative to compare the E.G.R. pressure difference across the restriction orifice 24 with the venturi vacuum and modulate the intake manifold vacuum to be supplied through the fifth pressure conduit 205 to the E.G.R. control valve 22 so that volumetric amount of exhaust gases recirculated through the E.G.R. passage 21 back into the intake manifold 3 is proportional to the volumetric amount of the engine.

The E.G.R. control valve 22 includes a valve housing 91, diaphragm 92 extending across the interior of the housing and a bellows member 93. The housing 91, the diaphragm 92 and the bellows member 93 cooperate together to define two pressure chambers 94 and 95. The first pressure chamber 94 defined by the housing 91 and the diaphragm 92 is pneumatically connected with the fifth pressure conduit 205 so that the engine intake manifold vacuum modified by the pressure comparator and modulator 10 is fed into the chamber 94.

The second pressure chamber 95, which is defined by the housing 91, the diaphragm 92 and the bellows member 93, is vented to the atmosphere by air vent holes 97 formed in the housing 91. A valve stem 98 has an end secured to the diaphragm 92 and the other end secured to a valve head 90 which is disposed adjacent to a valve seat 21*a* formed in the E.G.R. passage 21 so that the valve head 90 cooperates with the valve seat 21*a* to control the recirculation of exhaust gases from the exhaust manifold 2 back into the intake manifold 3. A compression coil spring 99 is disposed in the first pressure chamber 94 and extends between the housing 91 and the diaphragm 92 to bias the latter downwardly as viewed in FIG. 1. The intake manifold vacuum as modulated by the pressure comparator and modulator 10 and fed through the fifth pressure conduit 205 into the first pressure chamber 94 acts on the diaphragm 92 against the force of the compression spring 99. The position of the valve head 90 is determined by the balance between the force of the spring 99 and the intake manifold vacuum as modulated by the pressure comparator and modulator 10. The position of the valve head 90 thus determined defines the cross-sectional area of the E.G.R. passage 21 through which exhaust gases can flow (this cross-sectional area will be called hereunder "exhaust gas-flow cross-section of the E.G.R. passage"). It will be appreciated that, when the force of the modulated intake manifold vacuum tending to upwardly pull the diaphragm 92 is greater than the force of the spring 99 downwardly biasing the diaphragm 92, the valve head 90 is moved away from the valve seat 21*a* toward a fully open position to increase the exhaust gas-flow cross-section of the E.G.R. passage 21 for thereby reducing the resistance of the E.G.R. control valve to the recirculation of the exhaust gas. On the other hand, when the force of the spring 99 acting on the diaphragm 92 is greater than the force of the modulated intake manifold vacuum acting on the diaphragm, the valve head 90 will be moved toward its closed position to decrease the exhaust gas-flow cross-section of the E.G.R. passage 21 for thereby increasing the resistance of the E.G.R. control valve 22 to the recirculation of the exhaust gas.

Figure 2:
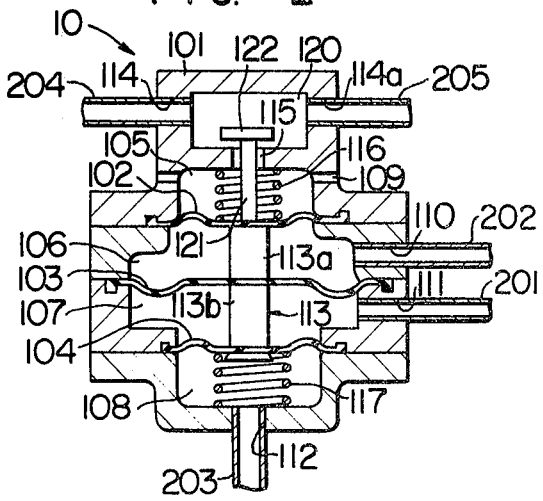
FIG. 2 is an enlarged sectional view of a pressure comparator and modulator shown in FIG. 1.

In FIG. 2, the pressure comparator and modulator 10 comprises a housing 101 and three diaphragms 102, 103 and 104 extending in spaced parallel relationship with each other anc across the interior of the housing to cooperate therewith to define four pressure chambers 105, 106, 107 and 108. The first pressure chamber 105 defined by the housing and the first diaphragm 102 is supplied with atmospheric air through vent holes 109 formed in wall of the housing 101. The second pressure chamber 106, which is defined by the housing 101 and the first and second diaphragms 102 and 103, has a pressure inlet port 110 connected to the pressure conduit 202 so that the exhaust gas pressure in the E.G.R. passage 21 downstream of the fixed restriction orifice 24 is introduced into the pressure chamber 106. The third pressure chamber 107, which is defined by the housing 101 and the second and third diaphragms 103 and 104, has a pressure inlet port 111 connected to the pressure conduit 201 so that the exhaust gas pressure in the E.G.R. passage 21 upstream of the restriction orifice 24 is introduced into the pressure chamber 107. The fourth pressure chamber 108, which is defined by the housing 101 and the third diaphragm 104, has a vacuum inlet port 112 connected to the pressure conduit 203 so that the venturi vacuum is introduced into the pressure chamber 108.

A link rod 113 comprises first and second rod members 113*a* and 113*b* disposed in the second and third pressure chambers 106 and 107 and extending between and secured to the first and second diaphragms 102 and 103 and the second and third diaphragms 103 and 104, respectively. The housing 101 further defines therein an additional or fifth pressure chamber 120 adjacent to and coaxial with the first pressure chamber 105. The fifth pressure chamber 120 has vacuum inlet and outlet ports 114 and 114a connected to the pressure conduits 204 and 205, respectively, and is communicated with the first pressure chamber 105 by a communication passage 115 through which loosely extends a valve stem 121 secured at one end to the first diaphragm 102. A valve head 122 is disposed in the fifth pressure chamber 120 in opposite relationship to the communication passage 115 and secured to the other end of the valve stem 121 for movement therewith. The atmospheric air flows from the first pressure chamber 105 through the communication passage 115 into the fifth pressure chamber 120 to decrease the intake manifold vacuum fed through the pressure conduit 204 into the fifth chamber 120. The valve head 122 is operative to control the flow of the atmospheric air from the first chamber 105 through the communication passage 115 into the fifth chamber 120 to modulate the intake manifold vacuum fed into the fifth chamber 120 so that the thus modulated intake manifold vacuum is fed through the pressure conduit 205 into the chamber 94 of the E.G.R. control valve 22.

A first compression coil spring 116 is disposed in the first pressure chamber 105 and extends between the housing 101 and the first diaphragm 102 around the valve stem 121. A second compression coil spring 117 is disposed in the fourth pressure chamber 108 and extends between the housing 101 and the third diaphragm 104. The first and third diaphragms 102 and 104 have substantially equal pressure receiving areas smaller than the pressure receiving area of the second diaphragm The operation of the pressure comparator and modulator 10 will be mathematically discussed hereunder. The absolute value of the venturi vacuum is represented by $\Delta P$, the exhaust gas pressure upstream of the restriction orifice 24 is by $P_1$, the exhaust gas pressure downstream of the orifice 24 is by $P_2$, the exhaust gas pressure difference $(P_1 - P_2)$ across the orifice 24 is by $\Delta P_1$, the pressure receiving areas of the first, second and third diaphragms 102, 103 and 104 are by $a_1$, $a_2$ and $a_3$, respectively, and the forces acting downwardly in FIG. 2 are of minus (−) values. The force $F_1$ produced by the exhaust gas pressure $P_1$ upstream of the restriction orifice 24 is given by:

$$F_1=(P_1 \cdot a_2)-(P_1 \cdot a_3)=P_1(a_2-a_3) \quad (1)$$

Similarly, the force $F_2$ produced by the exhaust gas pressure $P_2$ is given by:

$$F_2=(P_2 \cdot a_1)-(P_2 \cdot a_2)=-P_2(a_2-a_1) \quad (2)$$

The equations (1) and (2) will be combined to give a composite force F:

$$F=P_1(a_2-a_3)-P_2(a_2-l) \quad (3)$$

Because the pressure receiving area $a_1$ of the first diaphragm 102 is equal to the pressure receiving area $a_3$ of the third diaphragm 104, as described previously, the equation (3) will be rewritten as follows:

$$F=P_1(a_2-a_1)-P_2(a_2-a_1)=(P_1-P_2)\cdot(a_2-a_1)=\Delta P_1(a_2-a_1) \quad (4)$$

The force F′ produced by the venturi vacuum is:

$$F'=-(\Delta P \cdot a_3) \quad (5)$$

The difference between the downward force F′ produced by the venturi vacuum and the upward force F produced by the exhaust gas pressure difference across the restriction orifice 24 will move the rod member 113, the valve stem 21 and the valve head 122. Assuming that the forces F and F′ are balanced in the position shown in FIG. 2, if the intake air flow is increased to increase the venturi vacuum being introduced into the fourth pressure chamber 108 of the pressure comparator and modulator 10, the rod 113 and the valve stem and head 121 and 122 are moved downwardly as viewed in FIG. 2 to either reduce or interrupt the flow of the atmospheric air from the first pressure chamber 105 through the communication passage 115 into the fifth pressure chamber 20, with a resultant increase in the vacuum fed through the conduit 205 to the E.G.R. control valve 22. On the other hand, if the intake air flow is decreased with resultant decrease in the venturi vacuum in the fourth pressure chamber 108, the valve head 122 is moved upwardly as viewed in FIG. 2 to increase the flow of the atmospheric air through the communication passage 115 into the fifth chamber 120 with resultant decrease in the vacuum fed from the fifth chamber 120 through the conduit 205 to the E.G.R. control valve 22. If the flow of the exhaust gases through the E.G.R. passage 21 is increased, the exhaust gas pressure difference across the restriction orifice 24, i.e., the difference in the exhaust gas pressures fed through the conduits 201 and 202 into the second and third pressure chambers 106 and 107, is increased with resultant movement of the valve head 122 in the upward direction as viewed in FIG. 2. Thus, the flow of the atmospheric air through the communication passage 115 into the fifth chamber 120 is increased to reduce the vacuum fed through the conduit 205 to the E.G.R. control valve 22. On the other hand, if the exhaust gas pressure difference across the restriction orifice 24 is unduely decreased, the valve head 122 and the associated components are moved downwardly as viewed in FIG. 2 so that the flow of the atmospheric air into the fifth chamber 120 is either decreased or interrupted with resultant increase in the vacuum fed from the fifth chamber 120 through the conduit 205 to the E.G.R. control valve 22.

The air flowing through the intake pipe 3a and the intake manifold 3 into the engine 1 at a rate determined by the position of the throttle valve 5 is mixed at the carburetor 5 with a fuel to produce an air-fuel mixture which is fed into combustion chambers of the engine and burnt to produce combustion products which are then discharged as exhaust gases from the engine 1 and through the exhaust pipe 2. At the venturi 7 of the carburetor 5 is produced a venturi vacuum which is related to the amount of the intake air as follows:

$$Qv=C_1A_1\sqrt{\Delta P}$$

wherein Qv is the volumetric quantity of intake air, $A_1$ is the intake air-flow cross-sectional area at the venturi 7, $\Delta P$ is the venturi vacuum by absolute pressure, and $C_1$ is the coefficient of intake air flow. On the other hand, the restriction orifice 24 in the E.G.R. passage 21 produces an exhaust gas pressure difference across the restriction orifice which pressure difference is related to the amount of the exhaust gases recirculated through the restriction orifice. The exhaust gas pressure difference will be represented by:

$$QEGRV = C_2A_2\sqrt{P_1 - P_2} = C_2A_2\sqrt{\Delta P_1}$$

wherein QEGRV is the volumetric quantity of recirculated exhaust gases, $A_2$ is the exhaust gas-flow cross-sectional area of the restriction orifice 24, $P_1$ is the exhaust gas pressure upstream of the restriction orifice, $P_2$ is the exhaust gas pressure downstream of the restriction orifice, $\Delta P_1$ is the exhaust gas pressure difference across the restriction orifice, and $C_2$ is the coefficient of exhaust gas flow. The exhaust gas pressure difference is made proportional to the venturi vacuum to make the volumetric quantity of the recirculated exhaust gases proportional to the volumetric quantity of the intake air, as will be described hereunder.

It is assumed that the pressure signal related to the quantity of intake air is proportional to the pressure signal related to the quantity of recirculated exhaust gases with components of the system being in the positions shown in FIG. 1. If the quantity of the intake air is increased to increase the venturi vacuum, the previously described pressure comparator and modulator 10 operates to increase the vacuum fed through the pressure conduit 205 into the chamber 94 of the E.G.R. control valve 22, so that the valve head 90 of the E.G.R. control valve 22 is moved toward its fully open position to increase the exhaust gas-flow cross-sectional area of the E.G.R. control valve 22 for thereby increasing the rate of exhaust gas recirculation through the E.G.R. passage 21 back into the intake manifold 3. On the other hand, if the intake air is decreased to decrease the venturi vacuum, the pressure comparator and modulator 10 operates to decrease the vacuum fed through the pressure conduit 205 into the chamber 94 of the E.G.R. control valve 22, so that the valve head 90 of the valve 22 is moved toward its fully closed position to decrease the rate of exhaust gas recirculation through the E.G.R. passage 21 back into the intake manifold 3. If the quantity of the exhaust gases flowing through the restriction orifice 24 is increased to unduely increase the exhaust gas pressure difference across the restriction orifice 24, the pressure comparator and modulator 10 operates to decrease the vacuum fed through the pressure conduit 205 into the chamber 94 of the E.G.R. control valve 22, so that the valve head 90 of the valve 22 is moved toward its closed position to reduce the exhaust gas-flow cross-sectional area of the E.G.R. passage 21 with resultant decrease in the exhaust gas recirculation through E.G.R. passage 21 back into the intake manifold 3. On the other hand, if the quantity of the exhaust gas flowing through the restriction orifice 24 is decreased to unduely decrease the exhaust gas pressure difference across the restriction orifice 24, the pressure comparator and modulator 10 operates to increase the vacuum fed through the pressure conduit 205 into the chamber 94 of the E.G.R. control valve 22, so that the valve head 90 is moved toward its fully open position to increase the exhaust gas recirculation through the E.G.R. passage 21 back into the intake manifold 3.

As such, the exhaust gas pressure difference across the restriction orifice 24 can be proportional to the venturi vacuum ($\Delta P_1 = K \cdot \Delta P$, wherein K is constant) to make the volumetric quantity of the recirculated exhaust gases proportional to the volumetric quantity of the intake air ($QEGRV = K_1 \cdot Qv$, wherein $K_1$ is constant).

The density of the air flowing through the venturi 7 can be considered substantially constant because the intake air pressure around venturi 7 can be substantially constant. Thus, the volumetric quantity of intake air is proportional to the quantity by weight of intake air ($Qw = \gamma a \cdot Qv$, wherein Qw is the quantity by weight of intake and $\gamma a$ is the density of intake air).

Figure 3:
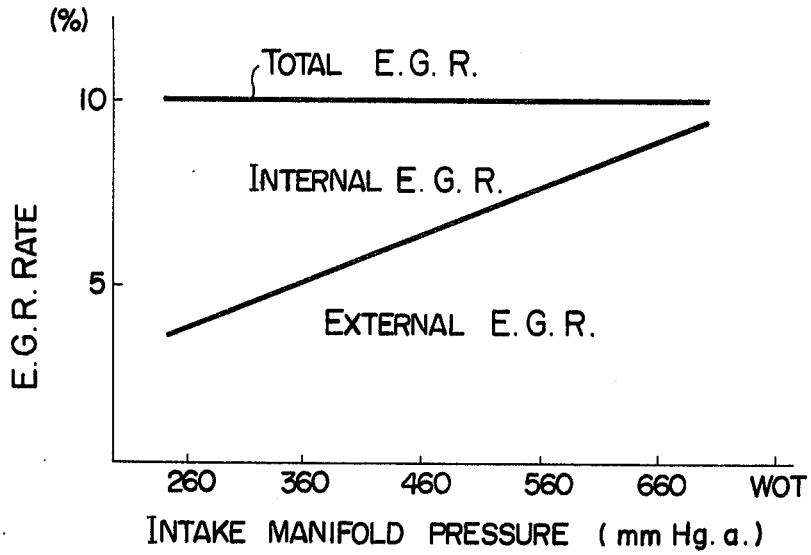
FIG. 3 graphically illustrates the relationship between internal and external E.G.R.s and total E.G.R.
Figure 4:
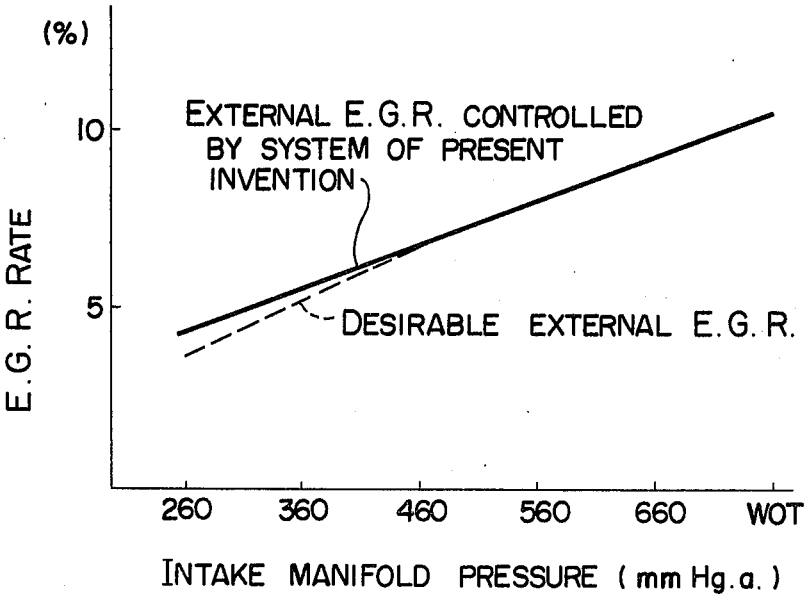
FIG. 4 graphically illustrates a desirable external E.G.R. and the external E.G.R. control characteristic provided by the system according to the present invention.

Within the exhaust manifold 2 is produced an exhaust pressure which is related to the quantity of exhaust gases discharged from the engine 1 ($QEXV = C_3A_3\sqrt{PEX}$, wherein QEXV is the volumetric quantity of exhaust gases discharged from the engine 1, $A_3$ is the exhaust gas flow cross-sectional area of the exhaust manifold 2, PEX is the exhaust pressure in the exhaust manifold, and $C_3$ is the coefficient of exhaust gas flow.) Since the volumetric quantity of exhaust gases (QEXV) is substantially proportional to the volumetric quantity of the intake air (Qv), the exhaust pressure (PEX) is increased when the load on the engine is increased and the volumetric quantity of intake air is thus increased. On the other hand, when the load on the engine is decreased with resultant decrease in the volumetric quantity of intake air (Qv), the exhaust pressure (PEX) is decreased. In the described and illustrated embodiment of the invention, the restriction orifice 24 is so positioned as to be subjected to the exhaust pressure (PEX) in the exhaust manifold 2. Considering the variation in the density of the exhaust gases flowing through the restriction orifice 24 which variation is due to the influence by the exhaust pressure (PEX) in the exhaust manifold 2, the quantity by weight of the exhaust gases recirculated from the exhaust manifold 2 back into the intake manifold 3 will be given by:

$$QEGRW = \gamma EX \cdot QEGRV = \gamma o \cdot (PEX_1 po) \cdot QEGRV = K \cdot PEX_1 \cdot QEGRV$$

wherein QEGRW is the quantity by weight of the recirculated exhaust gas, $\gamma o$ is the weight per unit of volume of the exhaust gases under atmospheric pressure, $\gamma EX$ is the weight per unit of volume of the exhaust gases under exhaust pressure by absolute pressure, $PEX_1$ is the exhaust pressure by absolute pressure, and Po is the atmospheric pressure. Thus, the quantity by weight of the recirculated exhaust gases is related to the exhaust pressure and, thus, is a function of the load on the engine. Namely, the ratio of the quantity by weight of the recirculated exhaust gases to the quantity by weight of the engine intake air (i.e., E.G.R. rate) is controlled according to the described system of the invention such that the external E.G.R. rate is increased and decreased as the engine load is increased and decreased, respectively. The exhaust gas recirculation system of the described embodiment provides an E.G.R. control characteristic which is very close to a desirable E.G.R. control, as will be seen in FIG. 4. Accordingly, the ratio of the total of the external E.G.R. provided by the described system and the internal E.G.R. provided by the residual combustion gases retained in combustion chambers, to the engine intake air (i.e., total E.G.R. rate) can be made substantially constant, as will be seen in FIG. 3 Thus, the exhaust gas recirculation system described is operative to most efficiently reduce the $NO_x$ emission.

Figure 5:
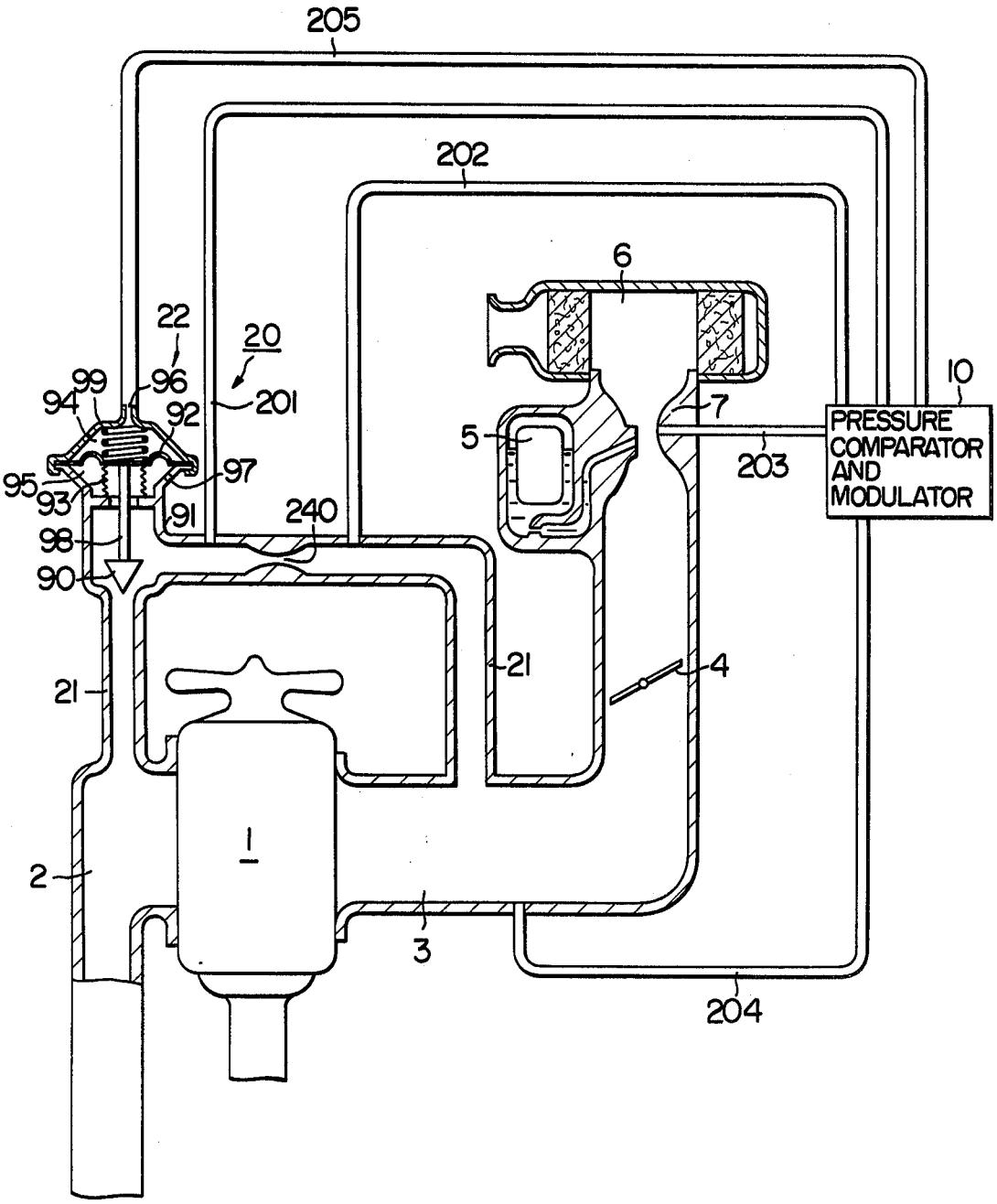
FIG. 5 is a view similar to FIG. 1 but illustrates a second embodiment of the invention.

FIG. 5 illustrates a second embodiment of the invention. Parts of the embodiment similar to those of the first embodiment are designated by similar reference numerals. The second embodiment is differentiated from the first embodiment only by that a restriction orifice 240 is disposed in the E.G.R. passage 21 downstream of the E.G.R. control valve 22 rather than upstream thereof as in the first embodiment. This arrangement also provides an advantageous operational characteristic similar to that of the first embodiment. Namely, the volumetric quantity of the exhaust gases recirculated by the embodiment is also proportional to the volumetric quantity of engine intake air.

On the other hand, the restriction orifice 240 is positioned in the E.G.R. passage 21 between the E.G.R. control valve 22 and the intake manifold 3 of the engine 1 and thus is subjected to the intake manifold vacuum. Considering the variation in the density of the exhaust gases flowing through the restriction orifice 240 which variation is due to the influence by the intake manifold vacuum, the quantity by weight of the exhaust gases recirculated from the exhaust manifold 2 through the E.G.R. passage 21 back into the intake manifold 3 will be given by:

$$QEGRW=\gamma v\cdot QEGRV=\gamma o\cdot(PV/P_o)\cdot QEGRV=-K_2\cdot PV\cdot QEGRV$$

wherein QEGRW is the quantity by weight of the recirculated exhausted gases, $\gamma v$ is the weight per unit of volume of the exhaust gases under absolute pressure within the intake manifold, QEGRV is the volumetric quantity of recirculated exhaust gases, $\gamma o$ is the weight per unit of volume of the exhaust gases under atmospheric pressure, PV is the absolute pressure produced in the intake manifold, Po is the atmospheric pressure, and $K_2$ is constant.

Thus, the quantity by weight of the recirculated exhaust gases is the function of the engine load. In other words, the second embodiment of the invention is also operative to control the ratio of the quantity by weight of the recirculated exhaust gases to the quantity by weight of the engine intake air (i.e., the E.G.R. rate) such that the external E.G.R. rate is increased and decreased as the engine load is increased and decreased, respectively. Accordingly, the E.G.R. control characteristic of the second embodiment of the invention is also very close to the desirable E.G.R. control shown in FIG. 4.

What is claimed is:

1. An exhaust gas recirculation system for an internal combustion engine having an intake system, including a carburetor venturi upstream of a throttle valve, and an exhaust system, comprising: an E.G.R. passage for recirculating engine exhaust gases from the exhaust system back into the intake system downstream of the throttle valve; and E.G.R. control valve means associated with said E.G.R. passage and operative in response to a pressure signal to vary the exhaust gas-flow cross-sectional area of said E.G.R. passage; a restriction means disposed in said E.G.R. passage; and a pressure comparator and modulator operative to compare the vacuum of the venturi with the pressure differential across said restriction means and modulate said pressure signal so that said pressure differential is always proportional to said venturi vacuum whereby the volumetric flow rate of recirculated exhaust gases is made proportional to the volumetric flow rate of engine intake air.

2. An exhaust gas recirculation system according to claim 1, wherein said pressure comparator and modulator comprises a housing, first to third diaphragm members extending in mutually spaced relationship across the interior of said housing to cooperate therewith to define first to fourth pressure chambers, the second and third pressure chambers being in communication with said E.G.R. passage immediately upstream and immediately downstream of said restriction means through first and second conduits, respectively, the fourth pressure chamber being in communication with said venturi through a third conduit, said housing defining therein a fifth pressure chamber having first and second ports pneumatically connected by fourth and fifth conduits to said intake system downstream of said throttle valve and to said E.G.R. control valve means, respectively, the first pressure chamber being vented to the atmosphere and in communication with said fifth pressure chamber through a communication passage, a valve member disposed in said fifth pressure chamber for movement toward and away from said communication passage to control the flow of the atmospheric air from said first pressure chamber through said communication passage into said fifth pressure chamber, and means mechanically connecting said valve member and said first to third diaphragm members together.

3. An exhaust gas recirculation system according to claim 2, wherein said E.G.R. control valve means includes a second housing, a fourth diaphragm member having one surface cooperating with said second housing to define a sixth pressure chamber pneumaticaly connected to said fifth conduit, and a second valve member disposed in said E.G.R. passage and mechanically connected to said fourth diaphragm member for movement therewith, the other surface of said fourth diaphragm member being exposed to the atmospheric pressure.

4. An exhaust gas recirculation system according to claim 3, wherein said restriction means comprises a restriction orifice disposed in said E.G.R. passage upstream of said E.G.R. control valve means.

5. An exhaust gas recirculation system according to claim 3, wherein said restriction means comprises a restriction orifice disposed in said E.G.R. passage downstream of said E.G.R. control valve means.

6. An exhaust gas recirculation system according to claim 3, wherein said first and third diaphragm members have substantially equal pressure receiving areas smaller than that of said second diaphragm member.

7. An exhaust gas recirculation system according to claim 6, wherein said pressure comparator and modulator further includes compression springs disposed between said first housing and said first diaphragm member and between said first housing and said third diaphragm member, respectively.

* * * * *